US009381977B2

(12) United States Patent
Leverette et al.

(10) Patent No.: US 9,381,977 B2
(45) **Date of Patent: *Jul. 5, 2016**

(54) IN-LINE MOORING CONNECTOR AND TENSIONER

(71) Applicant: Seahorse Equipment Corp, Houston, TX (US)

(72) Inventors: Steven John Leverette, Richmond, TX (US); Jack Pollack, Camarillo, CA (US)

(73) Assignee: Seahorse Equipment Corp, Houston, TX (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/660,520

(22) Filed: Mar. 17, 2015

(65) Prior Publication Data

US 2015/0191218 A1 Jul. 9, 2015

Related U.S. Application Data

(63) Continuation of application No. 13/950,476, filed on Jul. 25, 2013, now Pat. No. 9,003,994.

(60) Provisional application No. 61/675,650, filed on Jul. 25, 2012, provisional application No. 61/678,889, filed on Aug. 2, 2012.

(51) Int. Cl.

| | |
|---|---|
| ***B63B 21/00*** | (2006.01) |
| ***B63B 21/18*** | (2006.01) |
| *B63B 21/20* | (2006.01) |
| *B63B 21/50* | (2006.01) |

(52) U.S. Cl.

CPC ..... *B63B 21/00* (2013.01); *B63B 21/18* (2013.01); *B63B 21/50* (2013.01); *B63B 21/20* (2013.01); *B63B 21/508* (2013.01); *B63B 2021/003* (2013.01); *B63B 2021/007* (2013.01); *B63B 2021/203* (2013.01); *B63B 2021/505* (2013.01)

(58) Field of Classification Search

CPC ..... B63B 21/00
USPC ..... 114/230–231
See application file for complete search history.

(56) References Cited

U.S. PATENT DOCUMENTS

| | | | | | |
|---|---|---|---|---|---|
| 4,862,821 | A | * | 9/1989 | Ballantyne | B66D 1/72 114/200 |
| 4,889,065 | A | * | 12/1989 | van den Haak | B63B 21/22 114/293 |
| 4,936,710 | A | * | 6/1990 | Petty | E21B 17/01 114/265 |
| 5,240,446 | A | * | 8/1993 | Boatman | B63B 21/508 114/230.2 |
| 5,292,271 | A | * | 3/1994 | Boatman | B63B 21/508 114/230.12 |
| 5,356,321 | A | * | 10/1994 | Boatman | B63B 21/508 114/230.12 |
| 5,809,925 | A | * | 9/1998 | Montgomery | B63B 21/18 114/200 |
| 5,934,216 | A | * | 8/1999 | Childers | B63B 21/04 114/200 |

(Continued)

FOREIGN PATENT DOCUMENTS

| | | | | |
|---|---|---|---|---|
| GB | 2484840 B | | 9/2012 | |
| NL | WO 2013043049 A1 | * | 3/2013 | B63B 21/04 |
| WO | 2013043049 A1 | | 3/2013 | |

*Primary Examiner* — Lars A Olson
*Assistant Examiner* — Jovon Hayes
(74) *Attorney, Agent, or Firm* — Blank Rome LLP

(57) ABSTRACT

A mooring system for offshore vessels uses a chain stopper within a preset mooring line. The chain stopper has means for attaching a removable hydraulic chain jack actuator which may be used to stroke the chain through the stopper assembly while both the stopper and the mooring line remain under load.

26 Claims, 13 Drawing Sheets

(56) References Cited

U.S. PATENT DOCUMENTS 6,112,691 A * 9/2000 Bajeli ..... B63B 21/20 114/215
6,602,019 B1 * 8/2003 Rikli ..... B66D 3/006 24/136 R
6,983,714 B2 * 1/2006 Dove ..... B63B 21/04 114/230.2
7,059,262 B2 6/2006 Dove et al.
7,421,967 B1 * 9/2008 Fontenot ..... B63B 21/507 114/200
8,087,371 B1 * 1/2012 Sadegh ..... B63B 59/02 114/119
8,683,935 B2 * 4/2014 Bauduin ..... B63B 21/502 114/221 R
8,757,077 B2 * 6/2014 Edelson ..... B63B 21/50 114/230.2
9,003,994 B2 * 4/2015 Leverette ..... B63B 21/00 114/199
2002/0189522 A1 * 12/2002 Dove ..... B63B 21/04 114/293
2008/0229996 A1 9/2008 Fontenot et al.
2010/0024706 A1 * 2/2010 Foo ..... B63B 21/50 114/264
2012/0012044 A1 * 1/2012 Lavagna ..... B63B 21/508 114/230.12
2014/0026796 A1 * 1/2014 Leverette ..... B63B 21/00 114/230.24

* cited by examiner

IN-LINE MOORING CONNECTOR AND TENSIONER

CROSS-REFERENCE TO RELATED APPLICATIONS

This application is a continuation of U.S. patent application Ser. No. 13/950,476 filed on Jul. 25, 2013, and now issued as U.S. Pat. No. 9,003,994 which claims the benefit of U.S. Provisional Application No. 61/675,650, filed on Jul. 25, 2012, and U.S. Provisional Application No. 61/678,889, filed on Aug. 2, 2012.

BACKGROUND OF THE INVENTION

1. Field of the Invention

This invention relates to floating vessels. More particularly, it relates to mooring systems for offshore vessels.

2. Description of the Related Art Including Information Disclosed Under 37 CFR 1.97 and 1.98

When mooring offshore floating vessels and buoys, there is need for a method and apparatus to adjust the length and tension of the mooring lines. This need arises during initial installation to provide the correct geometry and pretension for the mooring system, and later in the life of the system, to account for changes to the system, wear, or creep in the mooring lines or anchor system. In certain situations, the adjustment of length must be performed over the lower section of the mooring, below a spring buoy. In some cases, the spring-buoy-to-vessel distance must be kept as initially deployed in order to preserve the proper function of the system.

One mechanism for performing these adjustments is described in U.S. Pat. Nos. 6,983,714 and 7,059,262 entitled Method and Apparatus for Offshore Mooring. These patents describe the use of a chain stopper/chain wheel to enable the motive force for line tensioning to be applied from a boat above, and to adjust the length of line above the preset portion of the line.

GB2484840 describes the use of a subsea chain jack on a subsea buoy. Tensioning apparatus is provided for tensioning a tether extending between a first structure and second structure. A support bracket is provided for attaching the apparatus with respect to the first structure. A tether holding arrangement is provided for securing the tether with respect to the apparatus. A pivotable articulating member having a tether receiving channel therethrough is provided, the receiving channel having a longitudinal axis substantially aligned with a tether departure axis. A support socket is adapted to pivotably receive the pivotable articulating member such that movement of the tether departure axis away from alignment with the receiving channel longitudinal axis results in corresponding pivotal movement of the pivotable articulating member with respect to the socket. A method of installing a production buoy using such tensioning apparatus is also described.

U.S. Pat. No. 5,934,216 describes a method and apparatus for tensioning and deploying mooring chain. A set of inboard and outboard pawls are provided in the tensioner/stopper device which may include a fairlead. The pawls are spaced and operate in a manner that at least one pair of pawls grabs the chain at any given time. This is said to prevent accidental loss of the chain overboard. The chain is tensioned as the inboard pawls are engaged to the chain and actuated hydraulically to pull the chain inboard. Pulling inboard allows the outboard pawls to slide over at least one link and lock into place behind that link. The inboard pawls are stroked outboard over the next link to be grabbed, with the outboard pawls engaging the chain, the inboard pawls slide outboard to obtain another grip on a subsequent link and the process is repeated to conclude the tensioning. For deployment, the outboard pawls are retracted while the chain is retained by the inboard pawls. The inboard pawls are stroked outboard to pay out the chain. At that time, the outboard pawls grab the chain for temporary support as the inboard pawls are repositioned for the next cycle.

U.S. Pat. No. 7,421,967 describes a mooring system for securing a floating vessel to the sea floor that comprises a plurality of mooring legs, at least one of which includes separate first and second mooring lines. The first mooring line comprises a first end which is connected to the vessel and the second mooring line comprises a first end which is secured to the sea floor. The mooring system also comprises a connection and tensioning device which includes a body, a bore which extends through the body, a chain stopper for adjustably securing the first mooring line to the body, and a connector for connecting a second end of the second mooring line to the body. In use, a second end of the first mooring line is inserted into the bore and the first mooring line is pulled through the bore while the body is subject to an opposing pulling force. Once the first mooring line is pulled through the bore a desired distance, the chain stopper maintains the first mooring line in position relative to the body to thereby secure the vessel to the sea floor.

U.S. Pat. No. 5,809,925 describes a chain stopper wherein a mooring chain is guided for movement through the frame of the chain stopper along a pair of upright rails, with vertical links of the chain received between the rails and horizontal links of the chain riding on top of the rails. A pawl is swingably mounted on the frame above the rails with inner legs of the pawl engaging a horizontal link of the chain at opposite sides of an adjacent vertical link. The pawl has outer legs which extend downward to a release pin. The release pin has grooves positioned to receive the bottom ends of the outer legs and prevent the pawl from moving in a direction which will allow loosening of the chain, unless the release pin is freed for rotation through an angle of about 90 degrees. The release pin is connected to a trigger assembly including a spinner block which is normally held against rotation by a trigger finger. Movement of the trigger finger frees the spinner block and thereby allows the release pin to move from a pawl-engaging to a pawl-released position. The force of the chain on the inner legs of the pawl swings the pawl automatically as the chain loosens by sliding along the rails. The spinner block rotates freely, with no mechanism restraining it or the release pin.

U.S. Pat. No. 4,862,821 describes a mechanism for tensioning a moving chain. In an anchoring system for a floating vessel which includes an anchor line comprising chain cable, a chain locker and a windlass having a chain wheel that conveys the chain cable during paying out from the chain locker, a mechanism is positioned between the chain locker and chain wheel to back-tension the chain during paying out. The mechanism has an axis along which the chain is passed with every second links oriented in a given plane. Paired brake shoes are positioned to either side of the plane and define braking surfaces of sufficient extent along the axis of chain movement that a given chain link and an immediately succeeding link of similar orientation can be simultaneously engaged during their movement to provide a continuous retarding effect. One pair of braking shoes is pivotally mounted on an appropriate support structure and urged with hydraulic cylinders towards the other pair thereby causing the brake shoes to engage the opposing faces chain link. The pressure of hydraulic fluid applied to the cylinders is adjusted to back-tension the chain sufficiently that sudden shocks to the windlass otherwise occasioned by tilting and jumping of chain links during conveyance over the chain wheel are avoided. Non-standard links and irregularities in the chain link surfaces such as weld lines are accommodated by contraction of the hydraulic cylinders and deflection of the pivoting brake shoes.

U.S. Pat. No. 4,936,710 describes a mooring line tensioning and damping system. The floating structure comprises one or more catenary mooring cables for anchoring the structure to the seabed. An extensible dynamic tensioner system is provided for maintaining a predetermined dynamic tension in each mooring cable, as the structure responds to cyclic wave forces, and for increasing the natural periods of oscillation of the pitch, roll, heave, surge, sway, and yaw motions of the moored floating structure by reducing the spring stiffness of the mooring system. A motion damping system is coupled between the dynamic tensioner system and the structure for damping the linear and angular displacements of the structure relative to the tensioned cables. The damping system selectively applies frictional forces against a movable member in the tensioner system. The movable member does not move relative to the cables.

U.S. Pat. No. 6,602,019 describes a device for fixing, tensioning or pulling an extensible traction element such as a cable. The device has two supports which can be moved in relation to each other in a transverse direction to the axis of the traction element. Several clamping jaws are mounted in displaceable fashion in pairs opposite each other on said supports. The clamping jaws have surfaces which grasp the traction element. When strain is placed on the traction element, the clamping jaws are displaced linearly at increasing distances except for the rear pair, in such a way that the clamping force can be evenly distributed over a great length, despite the extension of the traction element. This is said to allow, for example, steel cables with a high traction force to be tensioned without damaging the cable.

International Publication No. WO 2013/043049 describes a device for tensioning anchor chains, in particular mooring legs of off-shore vessels and installations, comprising a frame carrying connectors for holding together lower and upper portions of the chain to be tensioned. The frame further carries a tensioning mechanism for pulling at least one portion of the chain towards the other portion of the chain while the device is submerged.

BRIEF SUMMARY OF THE INVENTION

An in-line mooring connector and tensioner according to the invention comprises a chain stopper assembly that may be used to connect a chain to another line and a removable chain jack assembly which may be used to tension and adjust the chain that passes through the in-line mooring connector and tensioner. The in-line mooring connector and tensioner may be deployed between a chain and another line, and used to facilitate the adjustment of the overall length of the mooring by adjustment of the active length of the chain.

The removable chain jack may be configured such that it may be inserted over a tensioned chain when the locking pawls are oriented such that they are in-line with the cylinders. This allows adjustment to be performed without pulling the mooring line out of its normal geometry as would be required by a winch-actuated line to an auxiliary surface vessel.

An in-line mooring connector and tensioner according to the invention allows for tensioning and re-tensioning mooring lines without a vessel-mounted tensioning system.

A chain tensioning system according to the invention may include:

- Structural frame and fixed stopper assembly for each mooring line
- Removable chain jack assembly with movable stopper assembly
- Hoses and hose reel assembly for operating the chain jack
- Hydraulic power unit and controls for operating the chain tensioning system
- Applicable ROV interfaces and tooling

BRIEF DESCRIPTION OF THE SEVERAL VIEWS OF THE DRAWING(S)

DETAILED DESCRIPTION OF THE INVENTION

Figure 1:
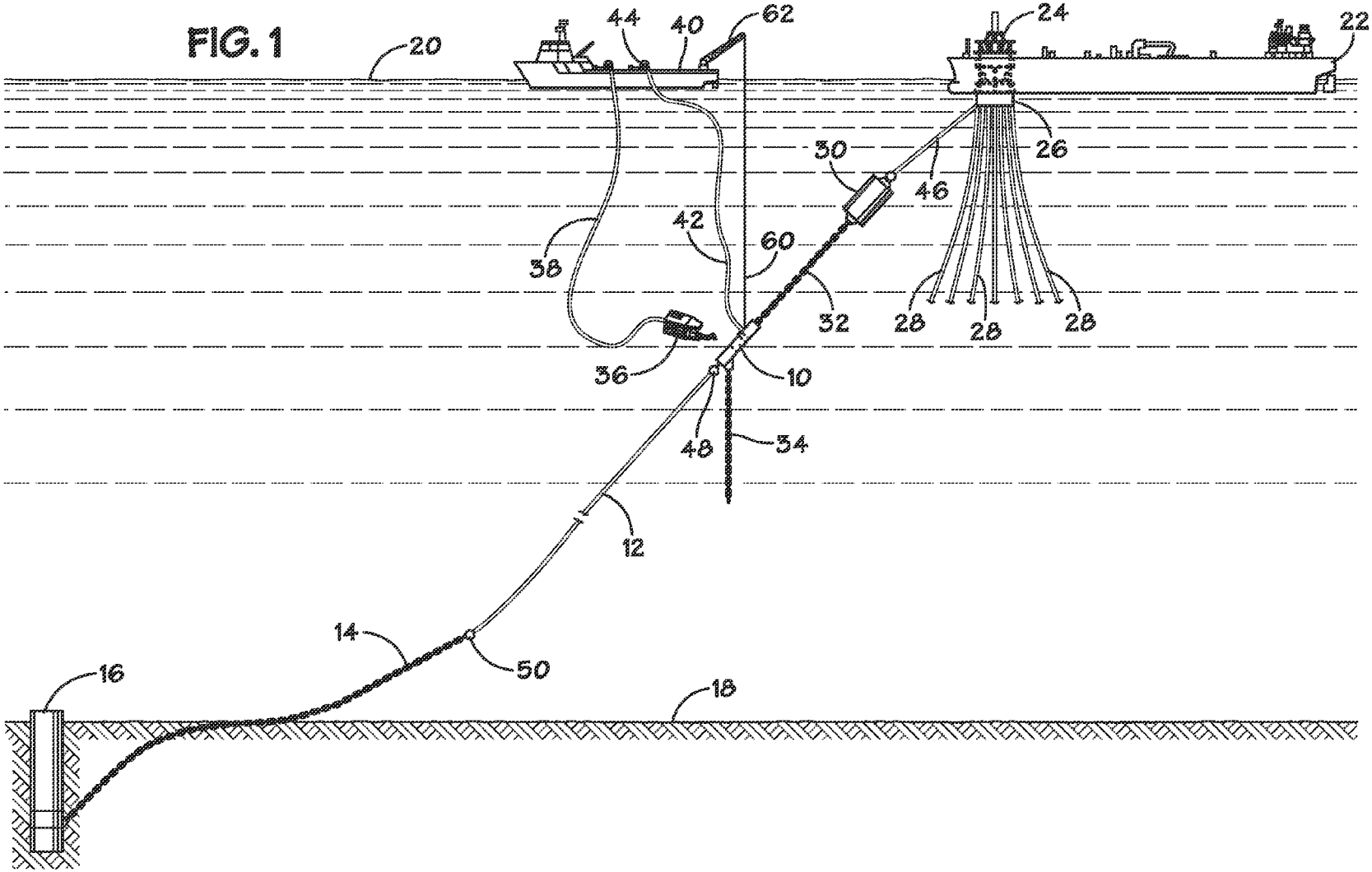
FIG. 1 is a schematic drawing of an in-line mooring connector and tensioner according to the invention connected to an FPSO and a work boat.

The invention may best be understood by reference to the exemplary embodiments illustrated in the drawing figures.

FIG. 1 shows a vessel 22 floating on surface 20 of the sea. In the illustration, vessel 22 is a disconnectable, turret-moored FPSO. Subsea risers 28 are attached at buoy 26, which may be connected to a rotatable turret 24. Vessel 22 may weathervane about turret 24.

Buoy 26 (and turret 24 when connected) are moored to the seabed 18 by a plurality of mooring lines 46. For clarity, only a single mooring line is shown in FIG. 1, but it should be understood that, in practice, a spread mooring system having at least three mooring lines would be used to position buoy 26 (and hence turret 24 and vessel 22).

Upper mooring line 46 connects between buoy 26 and spring buoy 30 which may support the lower portions of the mooring line.

An adjustment chain 32 is provided between spring buoy 30 and the anchor line 12 for adjusting the overall length of mooring line 46 (and hence the position of vessel 22). Adjustment chain 32 is comprised of an upper tensioned portion (at 32) and a lower, excess, slack portion 34. Adjustment chain 32 passes through, and is movably fixed to in-line mooring connector and tensioner 10 which is attached at connector 48 to anchor line 12 which may be a polyester line or any other suitable material. At its lower end, anchor line 12 is attached to ground chain 14 with connector 50. Ground chain 14 is secured to anchor 16 embedded in seafloor 18. Anchor 16 may be any suitable securing device.

In-line mooring connector and tensioner 10 contains a removable chain jack which may be installed and retrieved by one or more work lines 60 from deck-mounted crane 62 on vessel 40. Installation and retrieval of the removable chain jack may be assisted by a remotely operated vehicle (ROV) 36 controlled from workboat 40 via umbilical 38. Workboat 40 may be an Anchor Handling Vessel (AHV) or any such suitable vessel. In certain embodiments, hydraulic lines from hydraulic power unit (HPU) 44 on vessel 40, data sensor lines and other control and power means may connect to in-line mooring connector and tensioner 10 via umbilical 42. In this way, in-line mooring connector and tensioner 10 may be remotely cycled from vessel 40 to pay out or take in adjustment chain 32.

As illustrated in FIG. 1, the system of the present invention permits length and/or tension adjustment of mooring line 46 at a safe distance from vessel 22 and turret 24. This decreases the chances of interference with risers 28 or vessel 22.

An in-line mooring connector and tensioner according to a first embodiment of the invention is shown in FIGS. 2A, 2B, 2C and 2D. In-line mooring connector and tensioner 200 comprises chassis 210 which forms the frame of the mooring connector portion of the device—i.e., the portion which remains subsea and within the mooring line. Mooring line attachment fitting 212 is affixed to the lower end of chassis 210 and may be used to connect in-line mooring connector and tensioner 200 to an anchor line secured to the ocean floor.

Adjustment chain 214 is routed through in-line mooring connector and tensioner 200. The upper portion (at 214) is connected (directly or indirectly) to the vessel or other floating device being moored and is normally under tension. The lower or excess portion 218 is slack and may, in use, hang vertically from in-line mooring connector and tensioner 200 (see FIG. 1). Excess chain portion 218 may be directed to chain exit 216 by means of chain exit ramp 220. In other embodiments element 220 may be a rotating wheel, sprocket or the like. In certain embodiments, element 220 may include means for sensing the movement of chain 214, 218.

Chain stopper 224 is attached to chassis 210 and acts to lock chain 214 when in the closed position. Locking pawls (or "dogs") 228 bear against a link of chain 214 positioned within chain stopper 224 and transmit a compressive load from chain 214 to chassis 210. In the embodiment illustrated in FIGS. 2A-2D, chain stopper 224 is moved from the open (unlocked) position to the closed (locked) position (and vice versa) by hydraulic actuator 226. Linkage 227 may be provided to ensure that locking pawls 228 move equally. Hydraulic actuator 226 may be connected to an ROV or may be connected to a hydraulic power unit on a support vessel by an umbilical line 42 (as illustrated in FIG. 1).

Chain jack connector 222 is provided at the end of chassis 210 opposite anchor line attachment fitting 212. In the illustrated embodiment, connector 222 is a collar-type connector that permits sliding engagement of a removable chain jack.

Removable chain jack 230 comprises base plate 236 having U-shaped opening 238 sized and configured to slidingly engage connector 222 on the upper end of chassis 210 and permit the passage of chain 214 therethrough.

A pair of hydraulic cylinders 232 having double-acting actuators [piston rods] 234 retractably extending therefrom are mounted on base plate 236 such that they are arrayed on opposite sides of chassis 210 when chain jack 230 is installed. Hydraulic line connectors 252 may be attached to an ROV or to an umbilical line 42 leading to a hydraulic power unit on an attending surface vessel (as illustrated in FIG. 1).

Moveable plate 240 is attached to actuators 234 with piston rod connectors 244 and piston rod caps 242. Moveable plate 240 also has U-shaped opening 241 to permit the passage of chain 214 therethrough.

Second chain stopper 246 is mounted to base plate 240 and includes locking pawls 247 which may be moved between the opened and closed positions by hydraulic actuator 248. In other embodiments, the chain stoppers 246 and 224 may be opened and closed by other means known in the art.

Pad eyes 250 may be provided at various locations on chain jack 230 to provided attachment means for work lines 60 and the like for maneuvering chain jack 230 into position on chassis 210 and retrieving it when the tensioning operation is completed (see FIG. 1).

Figure 2A:
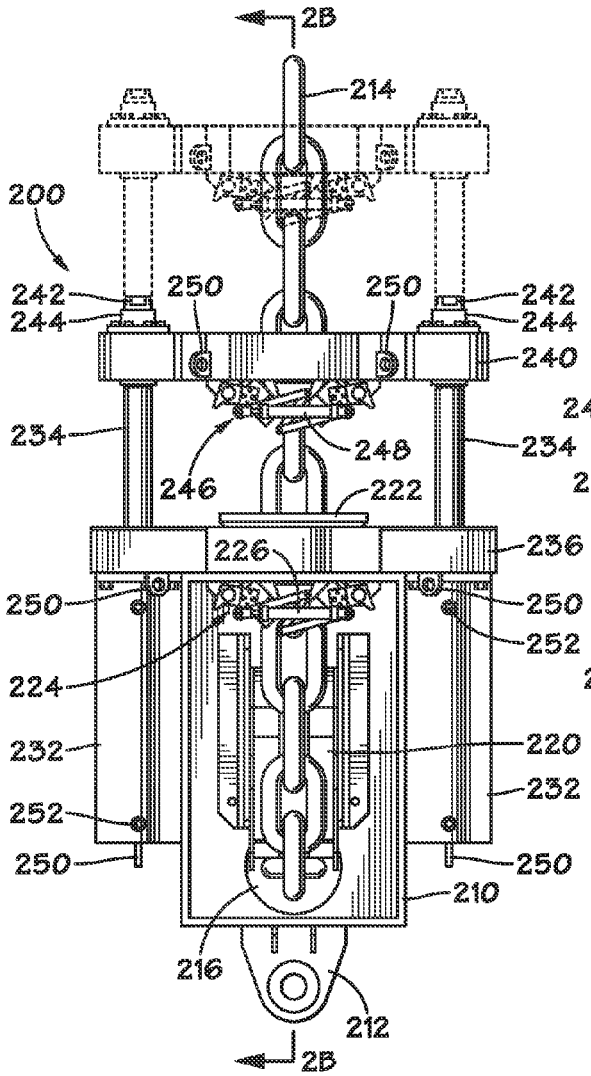
FIG. 2A is a front elevation of an in-line mooring connector and tensioner according to a first embodiment of the invention.
Figure 2B:
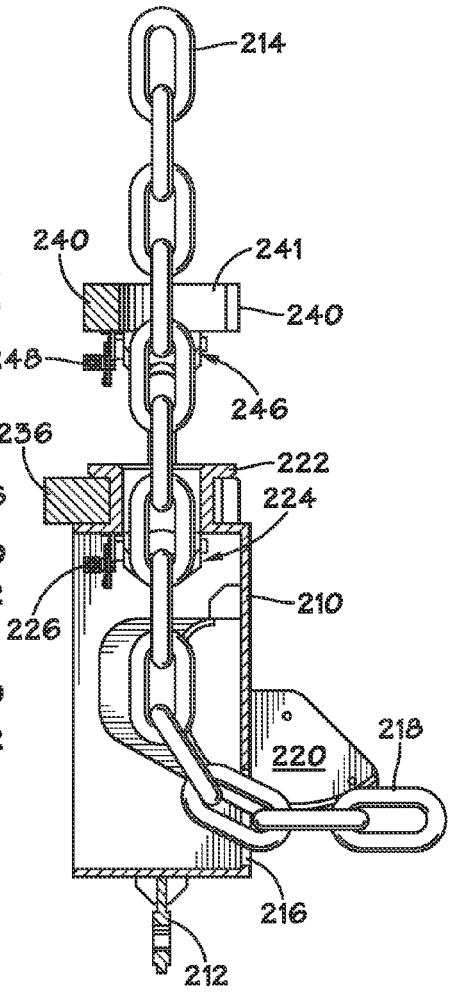
FIG. 2B is a cross-sectional view of the in-line mooring connector and tensioner illustrated in FIG. 2A taken along line 2B-2B in FIG. 2A.
Figure 2D:
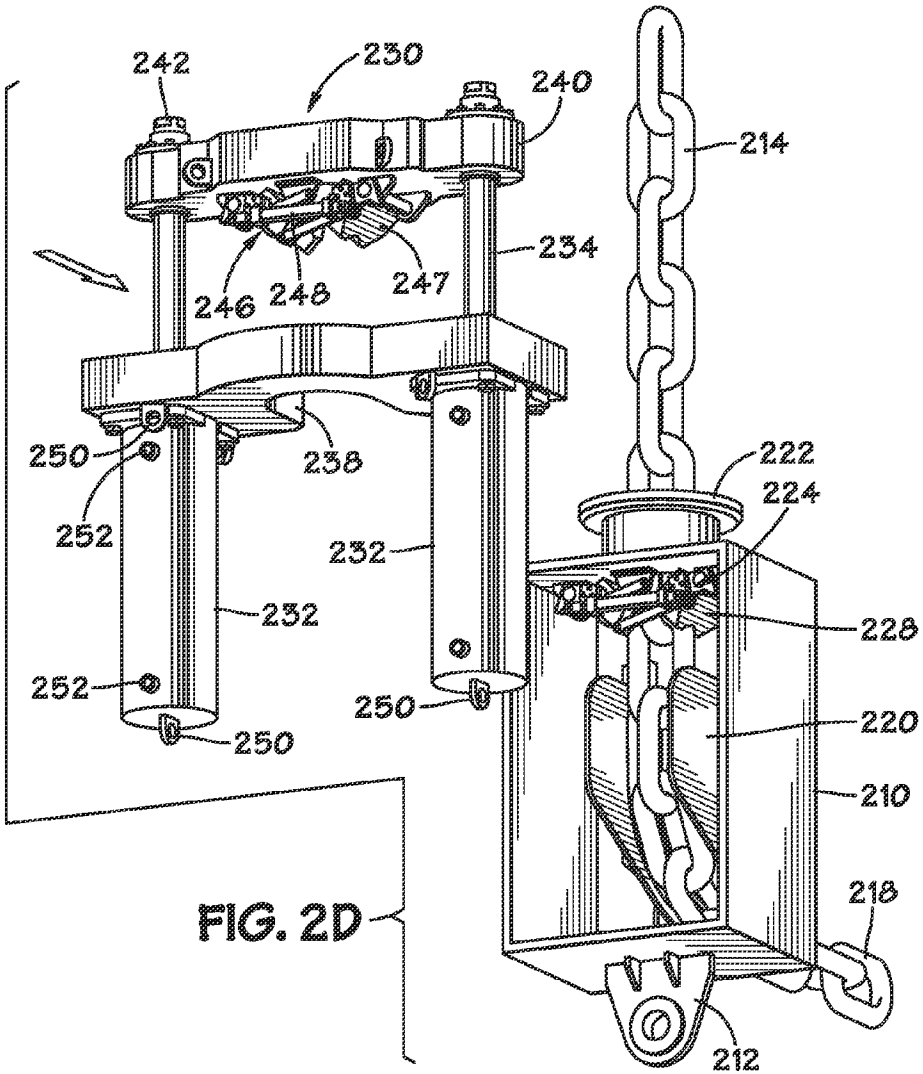
FIG. 2D is an exploded view of the in-line mooring connector and tensioner of FIG. 2A showing the chain jack being connected to the mooring connector.
Figure 2C:
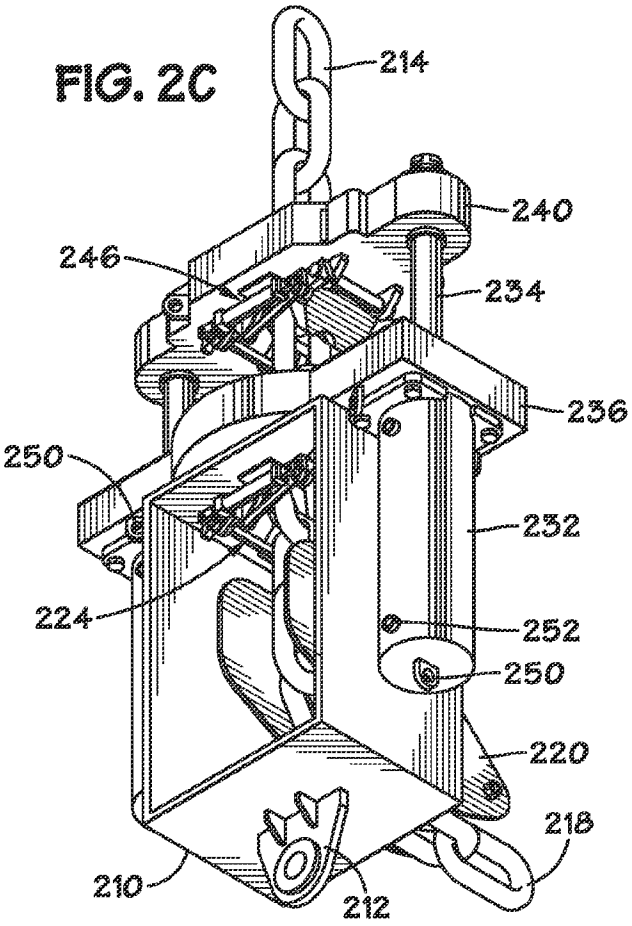
FIG. 2C is an isometric view of the in-line mooring connector and tensioner illustrated in FIG. 2A.
Figure 2E:
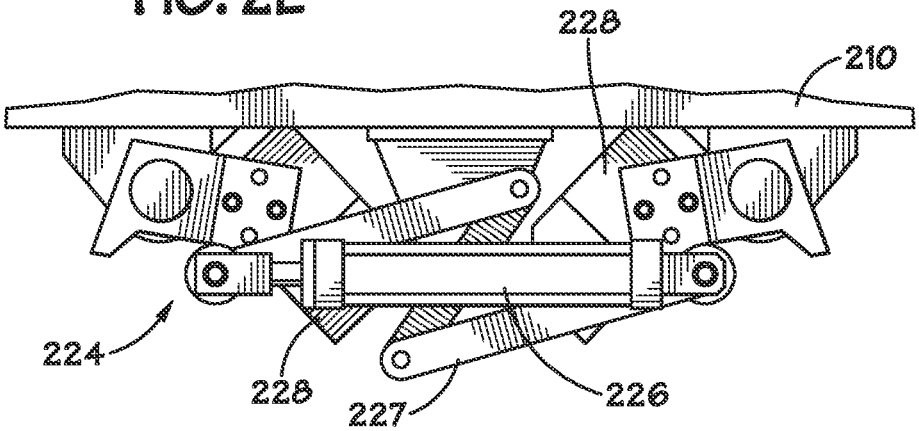
FIG. 2E is a side view of a hydraulically-actuated chain stopper in the closed position.
Figure 2F:
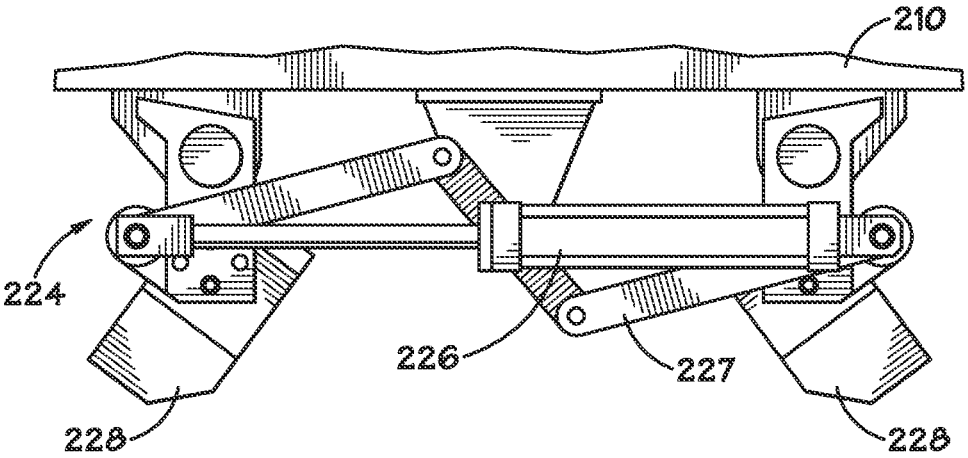
FIG. 2F is a side view of the chain stopper shown in FIG. 2E in the open position.

In operation, chain stopper 246 may be opened (while chain stopper 224 remains closed, preventing movement of chain 214) and moveable plate 240 extended (as shown in phantom in FIG. 2A). Actuators 234 may be sized such that their full extension corresponds to an integral number of chain links. When moveable plate 240 is fully extended (which may be detected by a position sensor [not shown] or, alternatively, by monitoring the flow or pressure of hydraulic fluid in cylinders 232), chain lock 246 may be closed and chain lock 224 may be opened. In certain embodiments, moveable plate 240 may be slightly retracted so as to relieve the chain tension on chain stopper 224 prior to opening chain stopper 224. When chain stopper 224 is fully open (as may be detected by one or more position sensors and/or fluid flow to actuator 226), moveable plate 240 may be retracted.

When moveable plate 240 is fully retracted, chain stopper 224 may be closed and chain stopper 246 opened. As described previously, actuators 234 may be slightly extended to relieve the load on chain stopper 246 prior to opening it.

This cycle may be repeated a selected number of times in order to achieve the desired level of tension in adjustment chain 214. The process may be automated. Sensors in chassis 210—e.g., strain gauges, or the like—may be used to determine the mooring line tension. This tension can also be determined from the hydraulic pressure in the chain jack when static with no hydraulic fluid flowing.

When the desired chain tension is achieved, chain stopper 246 may be locked in the open position and chain jack 230 removed from chassis 210 with lift lines guided by an ROV and retrieved. Because chain jack 230 is retrievable, it can be serviced and maintained on the surface.

It will be appreciated by those skilled in the art that the above-described process may be reversed to pay out chain 214.

An in-line mooring connector and tensioner according to a second embodiment of the invention is shown in FIGS. 3A, 3B, 3C and 3D. In-line mooring connector and tensioner 300 comprises chassis 310 which forms the frame of the mooring connector portion of the device—i.e., the portion which remains subsea and within the mooring line. Mooring line attachment fitting 312 is affixed to the lower end of chassis 310 and may be used to connect in-line mooring connector and tensioner 300 to an anchor line secured to the ocean floor.

Adjustment chain 314 is routed through in-line mooring connector and tensioner 300. The upper portion (at 314) is connected (directly or indirectly) to the vessel or other floating device being moored and is under tension. The lower or excess portion 318 is slack and may, in use, hang vertically from in-line mooring connector and tensioner 300 (see FIG. 1). Excess chain portion 318 may be directed to chain exit 316 by means of chain exit ramp 320. In other embodiments element 320 may be a rotating wheel, sprocket or the like. In certain embodiments, element 320 may include means for sensing the movement of chain 314, 318.

Chain stopper 324 is attached to chassis 310 and acts to lock chain 314 when in the closed position. Locking pawls (or "dogs") 328 bear against a link of chain 314 positioned within chain stopper 324 and transmit a compressive load from chain 314 to chassis 310. In the embodiment illustrated in FIGS. 3A-3D, chain stopper 324 is moved from the open (unlocked) position to the closed (locked) position (and vice versa) by hydraulic actuator 326. Hydraulic actuator 326 may be connected to an ROV or may be connected to a hydraulic power unit on a support vessel by an umbilical line 42 (as illustrated in FIG. 1).

Chain jack connector 322 is provided at the end of chassis 310 opposite anchor line attachment fitting 312. In the illustrated embodiment, connector 322 is a spline-type connector that permits sliding engagement of a removable chain jack.

Removable chain jack 330 comprises splined connector 323 on housing 337 sized and configured to slidingly engage slotted connector 322 on the upper end of chassis 310. Base plate 336 may include generally U-shaped opening 338 to permit the passage of chain 314 therethrough. Opening 338 may include elements to assist in orienting chain 314.

A pair of hydraulic cylinders 332 having double-acting actuators [piston rods] 334 retractably extending therefrom are attached at a first end to moveable plate 340 and, at an opposing second end, to cylinder plate 354. Hydraulic line connectors 352 may be attached to an ROV or to an umbilical line 42 leading to a hydraulic power unit on an attending surface vessel (as illustrated in FIG. 1).

Cylinder plate 354 may comprise generally U-shaped opening 358 to permit passage of chain 314 when chain jack 330 is installed onto chassis 310. As shown in FIG. 3D, opening 358 may be configured to orient chain 314 in the desired direction. Hinged gate 360 may be provided to close opening 358, thereby securing chain 314 within opening 358. Gate 360 may be equipped with a locking device operated by gate lock actuator 362 (see FIG. 3B). Gate lock actuator 362 may be configured for operation by an ROV.

Base plate 336 is attached to actuators 334 with piston rod connectors 344 and piston rod caps 342. Base plate 336 also has U-shaped opening 338 to permit the passage of chain 314 therethrough. Base plate 336 is also attached to housing 337 on the side opposite connector 323.

Second chain stopper 346 is mounted to moveable plate 340 and includes locking pawls 347 which are moved between the opened and closed position by hydraulic actuator 348. In other embodiments, the chain stoppers 346 and 324 may be opened and closed by other means known in the art.

Pad eyes 350 may be provided at various locations on chain jack 330 to provide attachment means for work lines 60 and the like for maneuvering chain jack 330 into position on chassis 310 and retrieving it when the tensioning operation is completed (see FIG. 1).

Figure 3A:
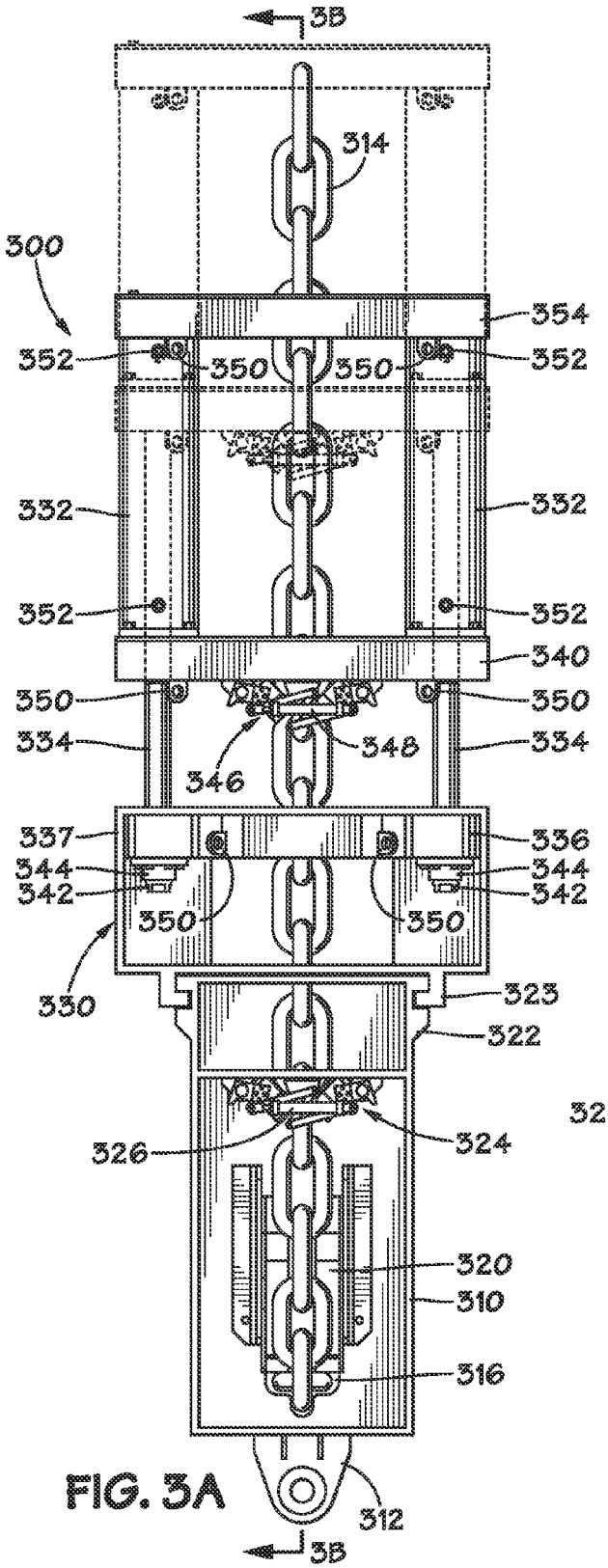
FIG. 3A is a front elevation of an in-line mooring connector and tensioner according to a second embodiment of the invention.
Figure 3B:
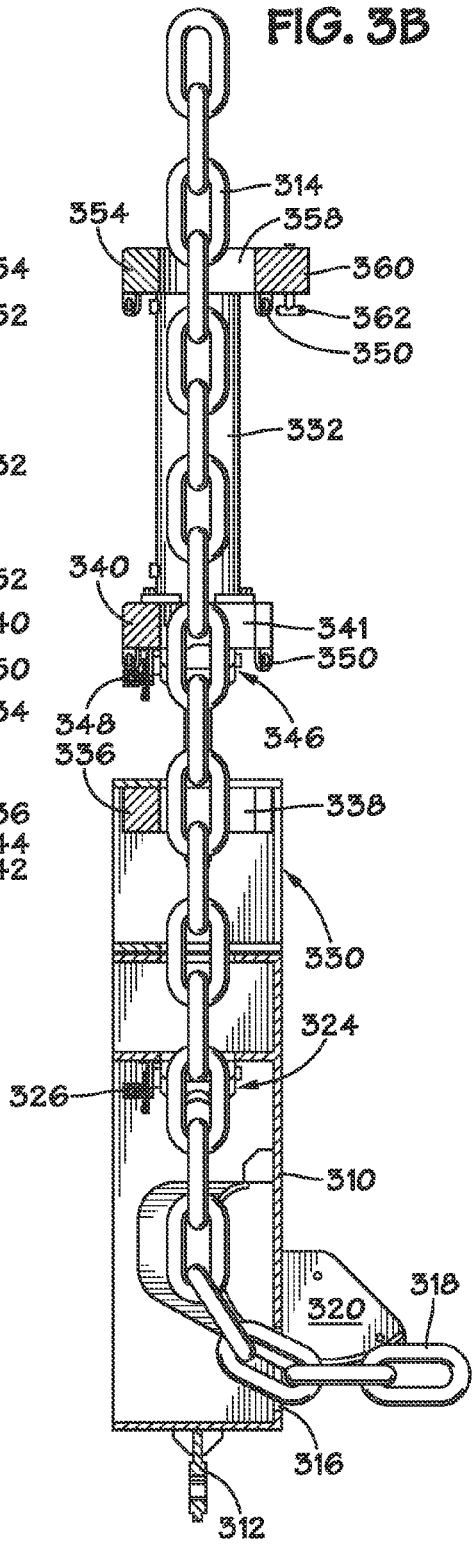
FIG. 3B is a cross-sectional view of the in-line mooring connector and tensioner illustrated in FIG. 3A taken along line 3B-3B in FIG. 3A.
Figure 3C:
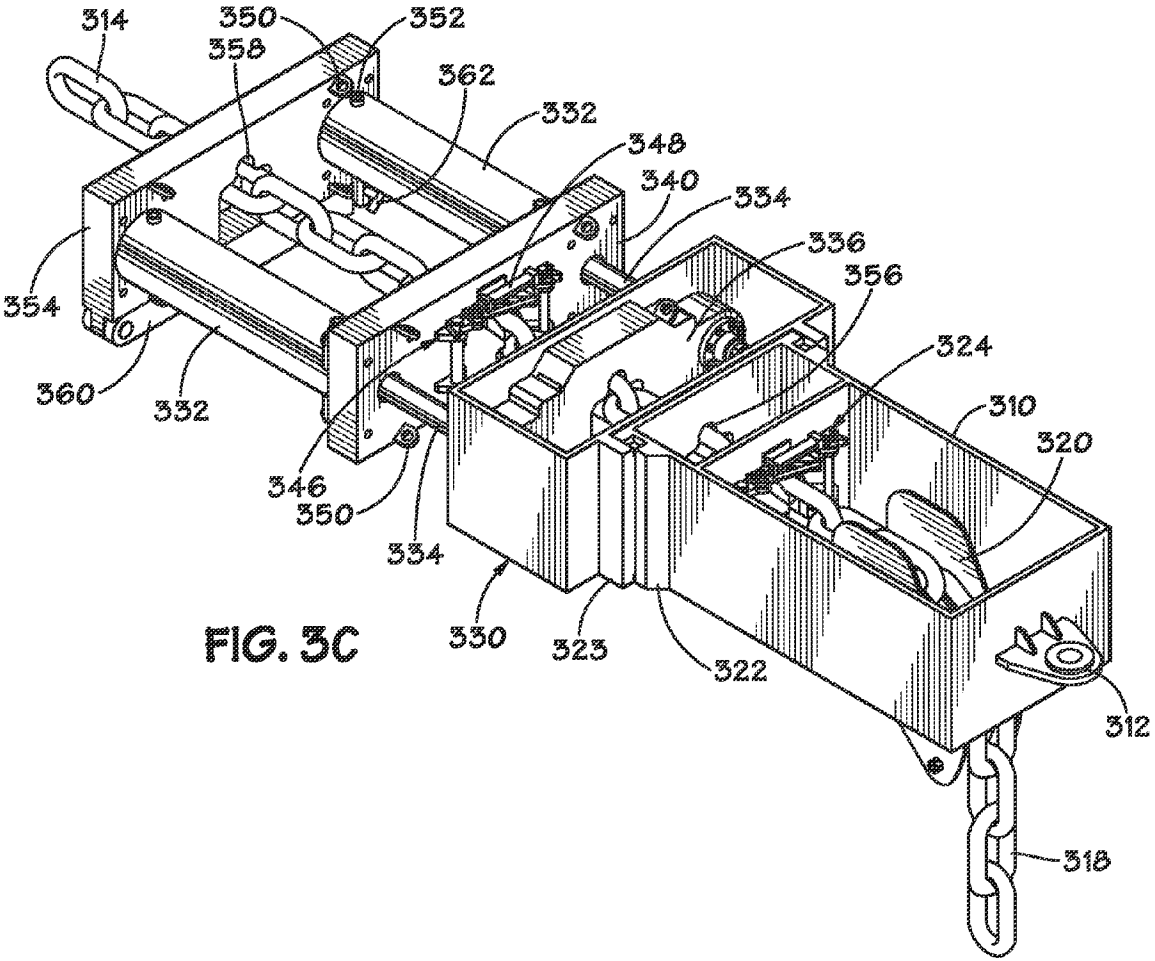
FIG. 3C is an isometric view of the in-line mooring connector and tensioner illustrated in FIG. 3A.
Figure 3D:
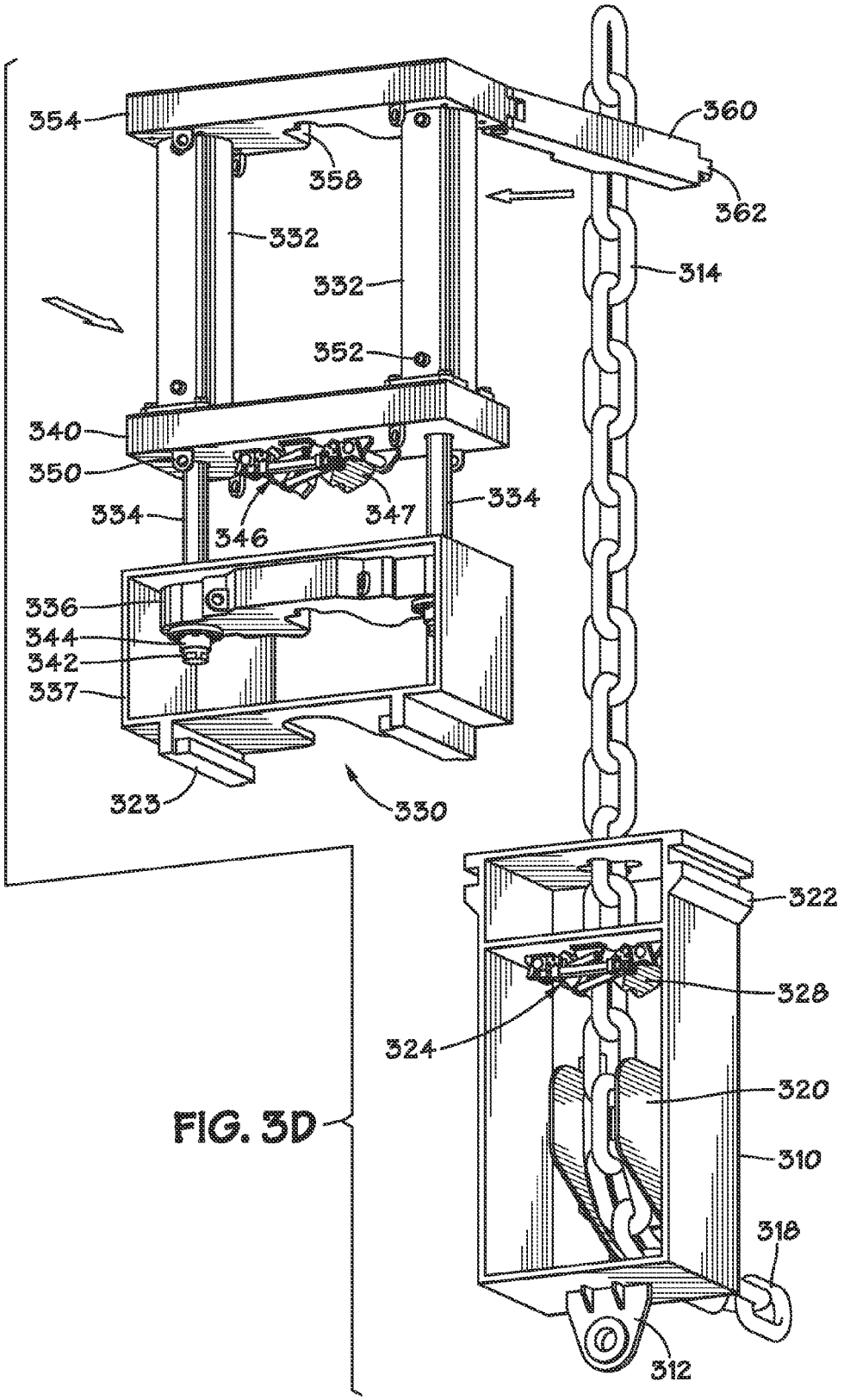
FIG. 3D is an exploded view of the in-line mooring connector and tensioner of FIG. 3A showing the chain jack being connected to the mooring connector.
Figure 4A:
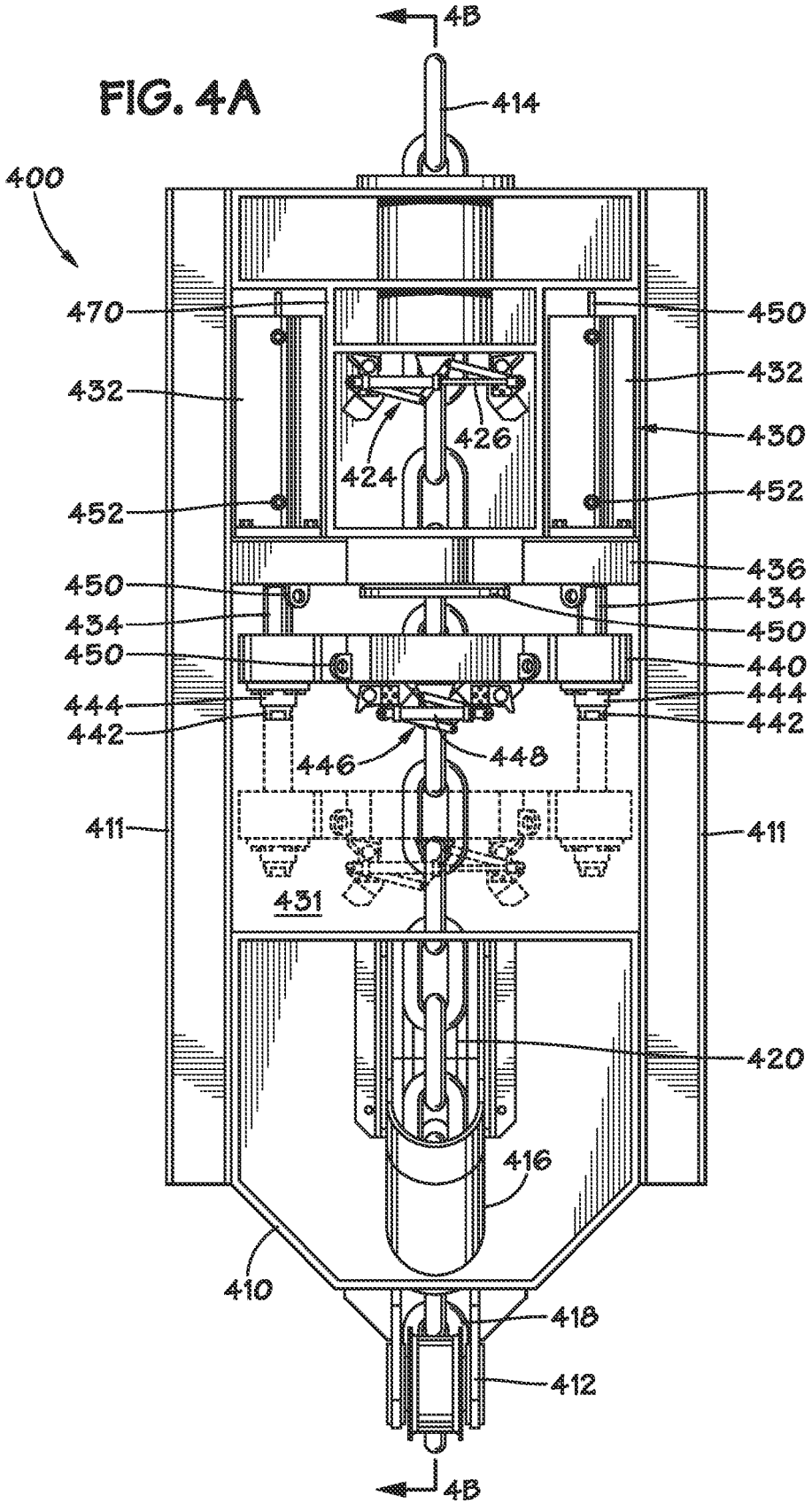
FIG. 4A is a front elevation of an in-line mooring connector and tensioner according to a third embodiment of the invention.
Figure 4B:
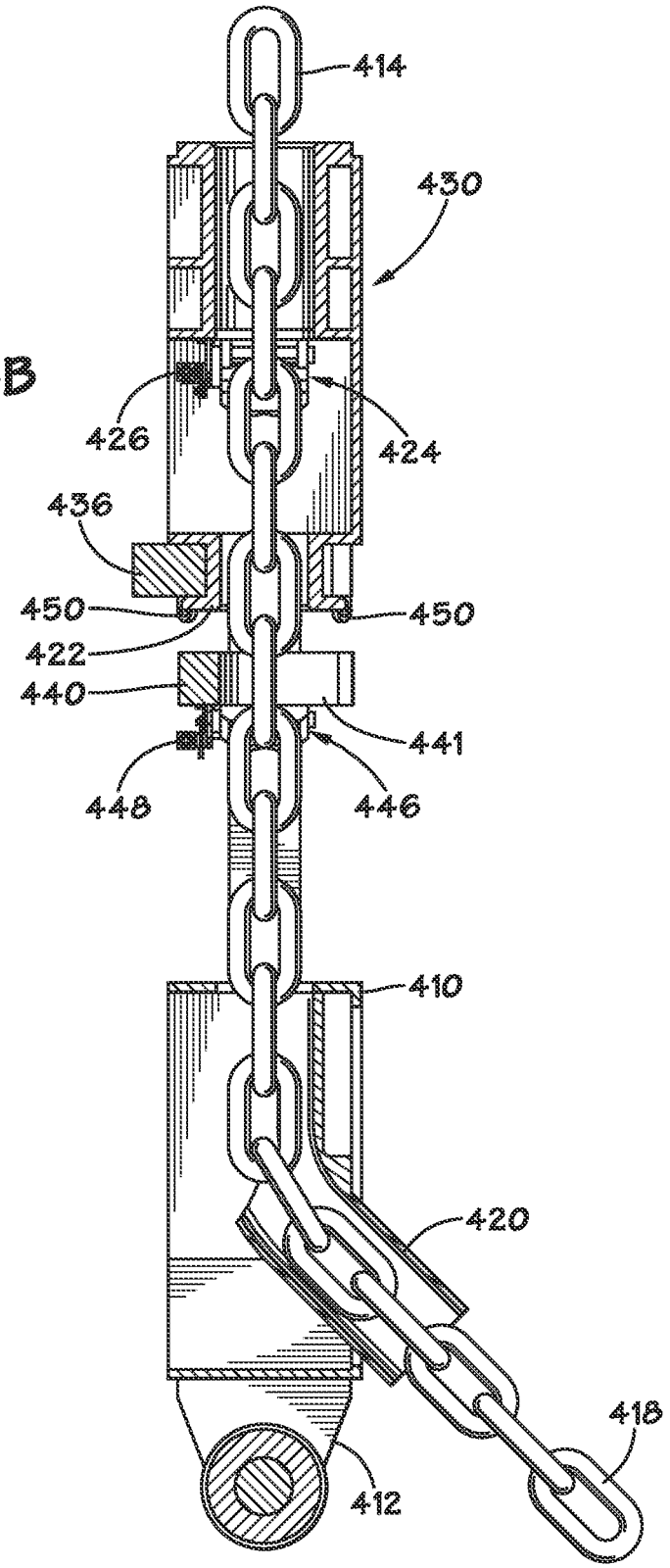
FIG. 4B is a cross-sectional view of the in-line mooring connector and tensioner illustrated in FIG. 4A taken along line 4B-4B in FIG. 4A.
Figure 4C:
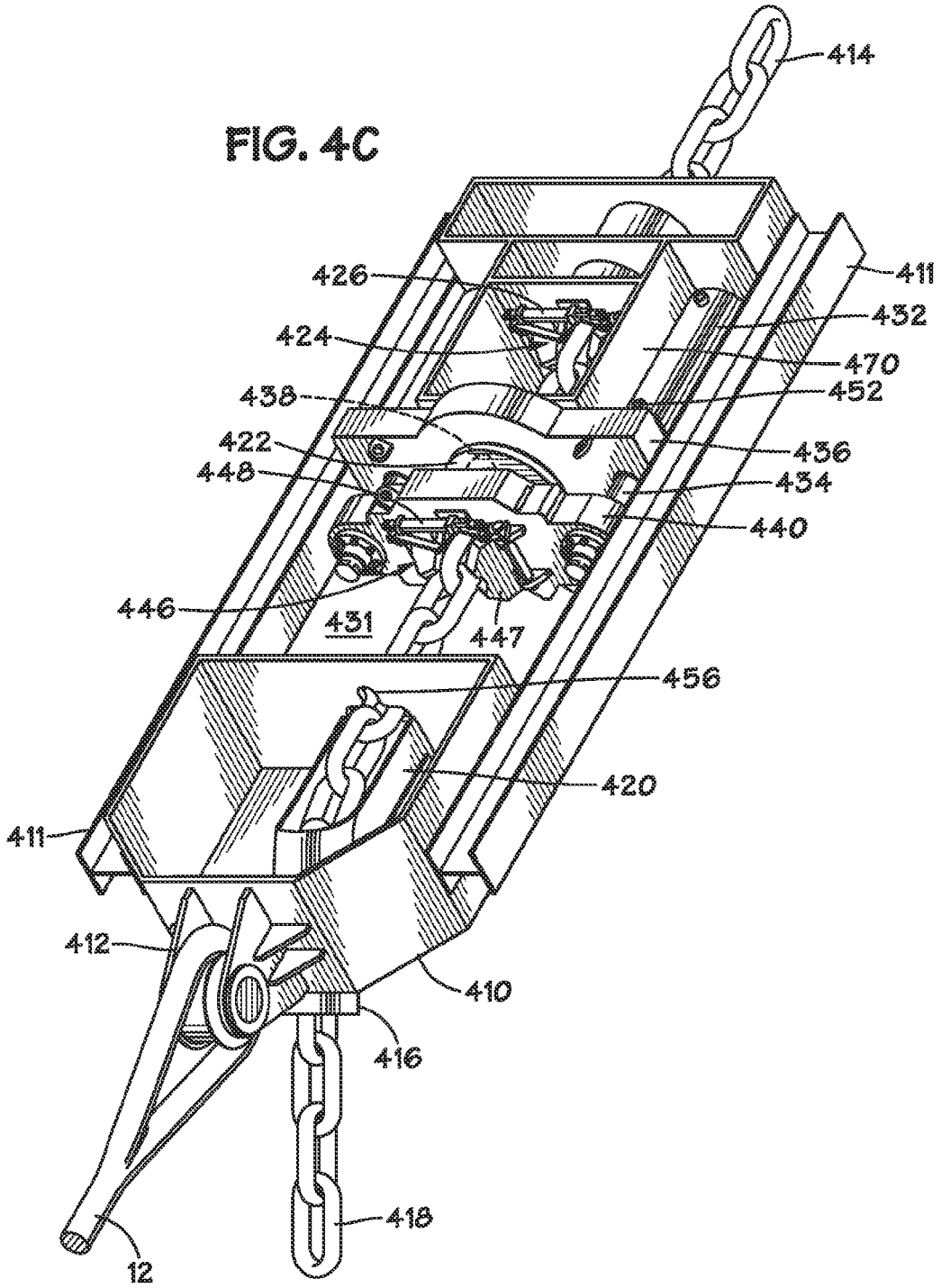
FIG. 4C is an isometric view of the in-line mooring connector and tensioner illustrated in FIG. 4A.
Figure 4D:
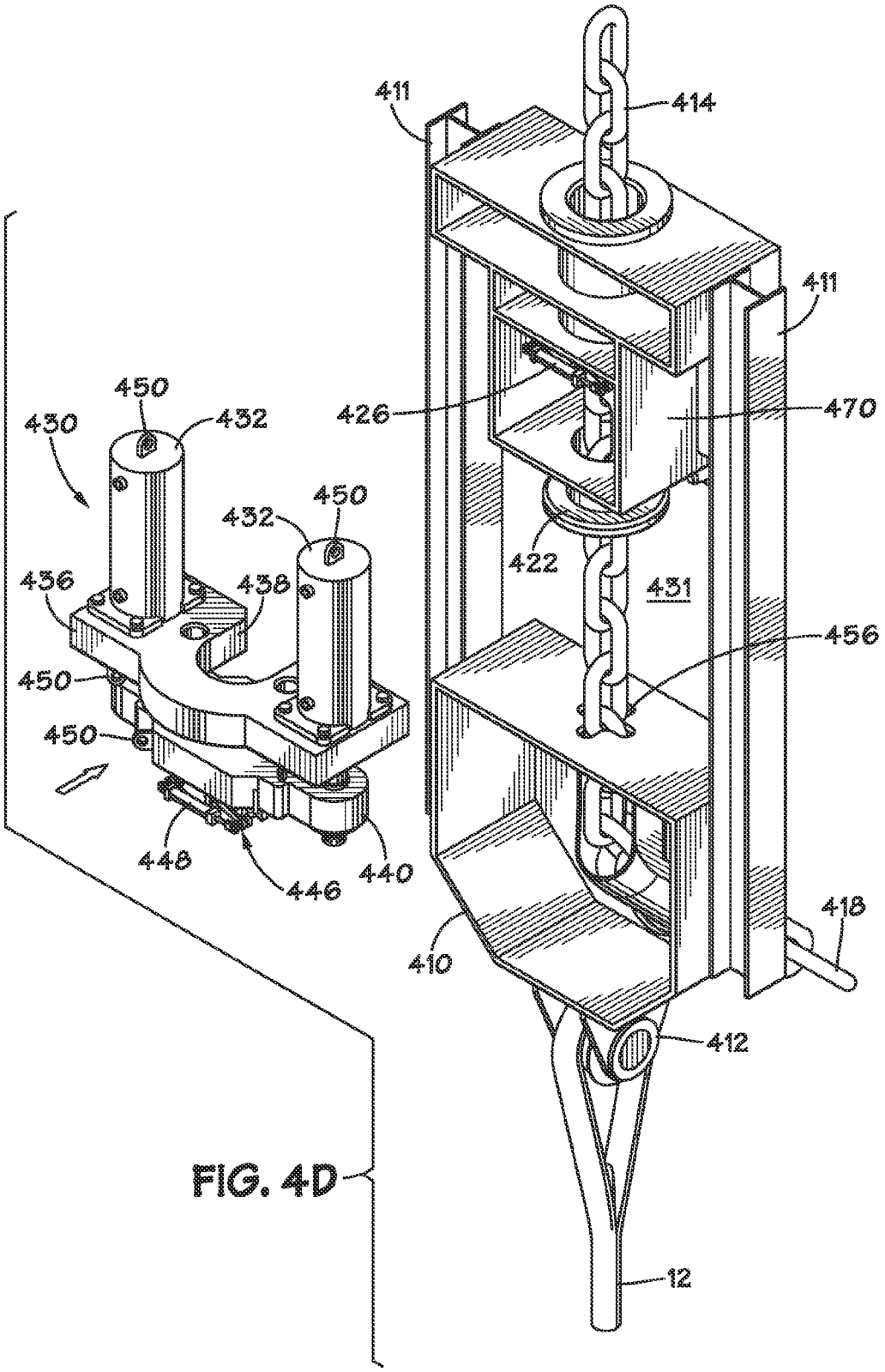
FIG. 4D is an exploded view of the in-line mooring connector and tensioner of FIG. 4A showing the chain jack being connected to the mooring connector.

In operation, chain stopper 346 may be opened (while chain stopper 324 remains closed, preventing movement of chain 314) and moveable plate 340 extended (as shown in phantom in FIG. 3A). Actuators 334 may be sized such that their full extension corresponds to an integral number of chain links. When moveable plate 340 is fully extended (which may be detected by a position sensor [not shown] or, alternatively, by monitoring the flow or pressure of hydraulic fluid in cylinders 332), chain lock 346 may be closed and chain lock 324 may be opened. In certain embodiments, moveable plate 340 may be slightly retracted so as to relieve the chain tension on chain stopper 324 prior to opening chain stopper 324. When chain stopper 324 is fully open (as may be detected by one or more position sensors and/or fluid flow to actuator 326), moveable plate 340 may be retracted—i.e., moved closer to base plate 336.

When moveable plate 340 is fully retracted, chain stopper 324 may be closed and chain stopper 346 opened. As described previously, actuators 334 may be slightly extended to relieve the load on chain stopper 346 prior to opening it.

This cycle may be repeated a selected number of times in order to achieve the desired level of tension in adjustment chain 314. The process may be automated. Sensors in chassis 310—e.g., strain gauges, or the like—may be used to determine the mooring line tension. This tension can also be determined from the hydraulic pressure in the chain jack when static with no hydraulic fluid flowing.

When the desired chain tension is achieved, chain stopper 346 may be locked in the open position and chain jack 330 removed from chassis 310 with lift lines guided by an ROV and retrieved. Because chain jack 330 is retrievable, it can be serviced and maintained on the surface.

It will be appreciated by those skilled in the art that the above-described process may be reversed to pay out chain 314.

An in-line mooring connector and tensioner according to a third embodiment of the invention is shown in FIGS. 4A-4D. In-line mooring connector and tensioner 400 comprises chassis 410 that forms the frame of the device and which remains subsea and within the mooring line. Flanged reinforcing rails 411 are provided on either side of chassis 410 to strengthen it.

Chain jack cavity 431 in the central portion of chassis 410 may be open to the front and/or the back of chassis 410 and is sized and configured to accommodate removable chain jack 430. Mooring line attachment fitting 412 is affixed to the lower end of chassis 410 and may be used to connect in-line mooring connector and tensioner 400 to an anchor line secured to the ocean floor.

Adjustment chain 414 is routed through in-line mooring connector and tensioner 400. The upper portion (at 414) is connected (directly or indirectly) to the vessel or other floating device being moored and is normally under tension. The lower or excess portion 418 is slack and may, in use, hang vertically from in-line mooring connector and tensioner 400 (see FIG. 1). Excess chain portion 418 may be directed to chain exit 416 by means of chain exit ramp 420. In other embodiments element 420 may be a rotating wheel, sprocket or the like. In certain embodiments, element 420 may include means for sensing the movement of chain 414, 418.

Chain stopper 424 is attached to chassis 410 within chain stopper housing 470 and acts to lock chain 414 when in the closed position. Locking pawls (or "dogs") 428 bear against a link of chain 414 positioned within chain stopper 424 and transmit a compressive load from chain 414 to chassis 410. In the embodiment illustrated in FIGS. 4A-4D, chain stopper 424 is moved from the open (unlocked) position to the closed (locked) position (and vice versa) by hydraulic actuator 426. Hydraulic actuator 426 may be connected to an ROV or may be connected to a hydraulic power unit on a support vessel by an umbilical line 42 (as illustrated in FIG. 1).

Base plate 436 may include generally U-shaped opening 438 sized and configured to slidingly engage collar connector 422 on the lower end (in FIG. 4A) of housing 470. Generally U-shaped opening 438 is sized and positioned to permit the passage of chain 414 therethrough.

A pair of hydraulic cylinders 432 having double-acting actuators [piston rods] 434 retractably extending therefrom are attached at a first end to base plate 436. Hydraulic line connectors 452 may be attached to an ROV or to an umbilical line 42 leading to a hydraulic power unit on an attending surface vessel (as illustrated in FIG. 1).

Movable plate 440 is attached to actuators 434 with piston rod connectors 444 and piston rod caps 442. Movable plate 440 also has U-shaped opening 441 to permit the passage of chain 414 therethrough.

Second chain stopper 446 is mounted to moveable plate 440 and includes locking pawls 447 which are moved between the opened and closed position by hydraulic actuator 448. In other embodiments, the chain stoppers 446 and 424 may be opened and closed by other means known in the art.

Pad eyes 450 may be provided at various locations on chain jack 430 to provided attachment means for work lines 60 and the like for maneuvering chain jack 430 into position within chassis 410 and retrieving it when the tensioning operation is completed (see FIG. 1).

In operation, chain stopper 446 may be closed (while chain stopper 424 is opened, preventing movement of chain 414). Moveable plate 440 may be extended slightly to relieve the load on chain stopper 424 to facilitate its opening. Moveable plate 440 may then be extended fully (as shown in phantom in FIG. 4A). Actuators 434 may be sized such that their full extension corresponds to an integral number of chain links. When moveable plate 440 is fully extended (which may be detected by a position sensor [not shown] or, alternatively, by monitoring the flow or pressure of hydraulic fluid in cylinders 432), chain lock 424 may be closed and chain lock 446 may be opened. In certain embodiments, moveable plate 440 may be slightly retracted so as to relieve the chain tension on chain stopper 446 prior to opening chain stopper 446. When chain stopper 446 is fully open (as may be detected by one or more position sensors and/or fluid flow to actuator 426), moveable plate 440 may be retracted—i.e., moved closer to base plate 436.

If another cycle is to be performed, chain stopper 446 may be closed when moveable plate 440 is fully retracted, and chain stopper 424 opened. As described previously, actuators 434 may be slightly extended to relieve the load on chain stopper 424 prior to opening it.

This cycle may be repeated a selected number of times in order to achieve the desired level of tension in adjustment chain 414. The process may be automated. Sensors in chassis 410—e.g., strain gauges, or the like—may be used to determine the mooring line tension. This tension can also be determined from the hydraulic pressure in the chain jack when static with no hydraulic fluid flowing.

When the desired chain tension is achieved, chain stopper 446 may be locked in the open position and chain jack 430 removed from chassis 410 with lift lines attached to pad eyes 450 and guided by an ROV and retrieved. Because chain jack 430 is retrievable, it can be serviced and maintained on the surface.

It will be appreciated by those skilled in the art that the above-described process may be reversed to effect pay out chain 414.

Figure 5A:
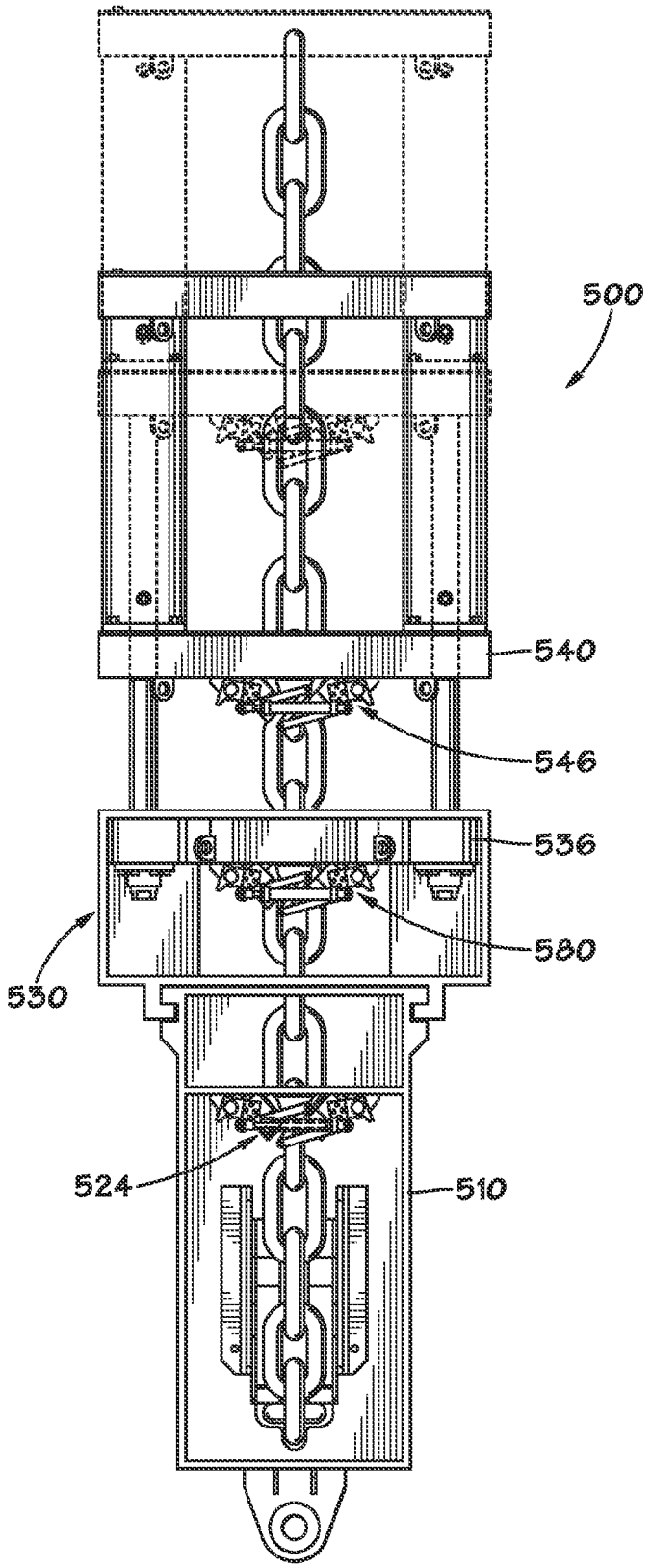
FIG. 5A is a front elevation of an in-line mooring connector and tensioner according to a fourth embodiment of the invention.

FIG. 5A shows a fourth embodiment of the invention. In-line mooring connector and tensioner 500 is similar to the second embodiment illustrated in FIGS. 3A-3D. However, the embodiment shown in FIG. 5A has three sets of chain stoppers—two in removable chain jack 530 (stopper 546 on movable plate 540 and stopper 580 on base plate 536) and a third (524) housed in chassis 510 that normally remains subsea. In operation, chain stopper 524 (the "permanent" chain stopper) may be opened at the beginning of the tensioning operation, remain open for the duration of the operation, and subsequently closed upon completion of the operation. In this way, the chain stoppers that must be repeatedly cycled during the tensioning operation (i.e., chain stoppers 546 and 580) are those that are on removable chain jack 530 which can be retrieved and serviced on the surface. Permanent chain stopper 524 need only be cycled once during the entire procedure. Because chain stopper 524 normally remains subsea, it is more likely to become fouled by marine organisms and/or corroded. This may adversely affect its ease of movement and hence increase the cycle time of the device if it must be operated on each stroke of the chain jack (as in the embodiment illustrated in FIGS. 3A-3D).

Figure 5B:
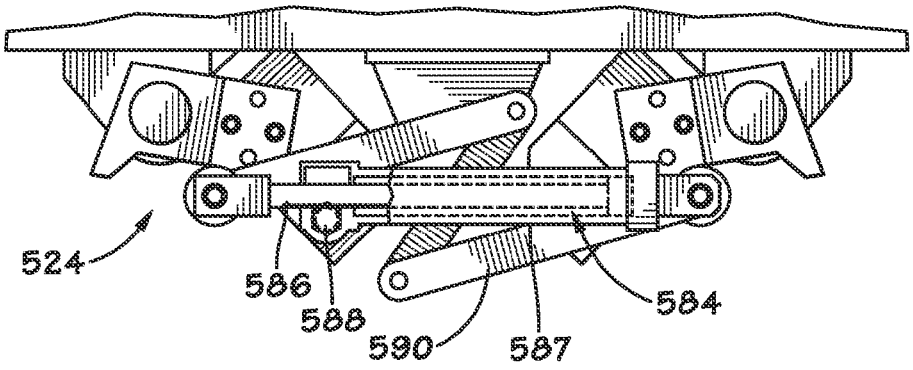
FIG. 5B is a side view of a mechanically-actuated chain stopper in the closed position.
Figure 5C:
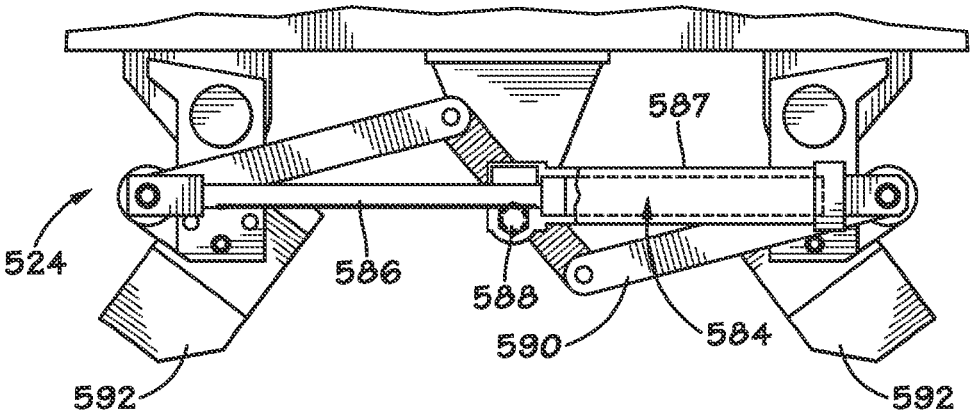
FIG. 5C is a side view of the chain stopper of FIG. 5B in the open position.

Chain stopper 524 may be of the same type as chain stoppers 546 and 580—i.e., hydraulically operated via an umbilical line from a surface vessel or via a hydraulic line connected to an ROV. Alternatively, chain stopper 524 may be mechanically actuated. One particular type of mechanically actuated chain stopper is illustrated in FIGS. 5B and 5C.

Chain stopper 524 is equipped with a rack-and-pinion type mechanical actuator 584 which comprises toothed rack 586 and geared pinion 588. Pinion 588 may have a hex head (or other such connector) to engage a rotatable driver on an ROV. Rack 586 may be driven in or out of housing 587 by rotating pinion 588. This action moves linkage 590 which is connected to locking pawls 592. Linkage 590 ensures that locking pawls 592 move equally.

An in-line mooring connector and tensioner according to the invention may be used in the following applications:

- Mooring line installation to initially pull in the spring buoy chain.
- Construction stretch removal from the polyester to pull in and pay out the spring buoy chain for applying an initial set to the polyester ropes.
- Mooring tension adjustment to correct for vessel position or riser load changes.
- Mooring tension adjustment for polyester rope creep over time and to rotate the chain link on the fixed stopper.
- Mooring chain paying out and pulling in permit removal of a polyester test insert if required (additional temporary chain will be added to permit this).

The structural frame of the in-line mooring connector and tensioner may contain the permanent chain stopper that remains subsea for the life of the mooring line. The interface to the chain jack may be configured to permit ease of installation of the chain jack using work wire to support the chain jack and ROV assistance to maneuver and lock in position on the structural frame.

A hydraulic umbilical from an AHV may provide the source of hydraulic power for operating the chain jack cylinders and the chain stopper cylinders if used. Hydraulic cylinders on the permanent chain stopper may be designed to be replaceable by an ROV. An ROV installation tool may be provided for subsea intervention of the cylinders.

Load monitoring may be implemented on the chain jack via pressure transmitters at the actuating cylinders. If the permanent chain stopper is hydraulically actuated, it may be configured so that no hydraulic pressure is needed during a static hold under load. The system may be designed such that, upon loss of hydraulic pressure, the grip on the chain is maintained.

The chain jack of an in-line mooring connector and tensioner according to the invention may be hydraulically driven and operated by a control console during normal paying in and paying out operations. The system may contain all necessary valving to automatically sequence the unit through the working cycle without operator intervention. It may also have manual override for control of the individual functions. The operator may have visibility of the operation from an ROV-mounted camera.

The system may further be provided with:

A control console.

A load cell to provide pulling load indication during installation operations.

An encoder measuring total and partial chain paid-in/out.

A flow control device to control the pull speed.

An adjustable speed facility during paying in and paying out operations.

In cases where lower mooring line 12 is polyester, it may also be necessary to readjust the length of the mooring line due to creep of the material over time. In that case, the in-line mooring connector and tensioner may be used to incrementally tension the line to maintain the proper pre-tension and mooring geometry.

Practice of the invention allows the use of a chain jack mid-span in a mooring line. It allows tension adjustments to be performed without pulling the mooring line out of its normal geometry as would be required by a winch-actuated line to an auxiliary surface vessel. The invention also permits use of a chain jack to act on a tensioned line by side entry.

Although particular embodiments of the present invention have been shown and described, they are not intended to limit what this patent covers. One skilled in the art will understand that various changes and modifications may be made without departing from the scope of the present invention as literally and equivalently covered by the following claims.

What is claimed is:

1. An in-line mooring chain tensioner comprising:

a chassis having a first, upper end and an opposing, second, lower end;

a connector on the second end of the chassis configured to engage an anchor line;

a first opening in the first end of the chassis sized and configured to permit the passage of a mooring chain;

a second opening in the chassis proximate the second end; and, a chain jack removably mounted within the chassis.

2. The in-line mooring chain tensioner recited in claim 1 wherein the second opening in the chassis is configured to direct a mooring chain exiting the chassis in a generally downward direction, off-axis the chassis.

3. The in-line mooring chain tensioner recited in claim 1 further comprising:

a first chain stopper within the chassis moveable from a first position that engages a mooring chain passing from the first opening through the second opening to a second position that permits movement of the chain through the chassis.

4. The in-line mooring chain tensioner recited in claim 1 wherein the chain jack comprises:

a base plate having a central opening;

at least one hydraulic cylinder attached to the base plate and a hydraulic actuator extending from the cylinder; and, a moveable plate having a central opening said plate connected to the hydraulic actuator and parallel to the base plate.

5. The in-line mooring chain tensioner recited in claim 4 further comprising:

a second chain stopper mounted on the moveable plate and moveable from a first position that engages a mooring chain passing through the central opening to a second position that permits movement of the chain through the central opening.

6. The in-line mooring chain tensioner recited in claim 1 wherein the chassis is open on at least one side so as to permit removal of the chain jack.

7. The in-line mooring chain tensioner recited in claim 5 wherein the first and second chain stoppers are hydraulically actuated.

8. The in-line mooring chain tensioner recited in claim 7 wherein the first and second chain stoppers are configured for hydraulic actuation by a subsea remotely operated vehicle.

9. The in-line mooring chain tensioner recited in claim 5 wherein the first and second chain stoppers are configured for hydraulic actuation via an umbilical line from a surface vessel.

10. The in-line mooring chain tensioner recited in claim 4 wherein the hydraulic cylinder of the chain tensioner is configured for hydraulic actuation by a subsea, remotely operated vehicle.

11. The in-line mooring chain tensioner recited in claim 4 wherein the hydraulic cylinder of the chain tensioner is configured for hydraulic actuation via an umbilical line from a surface vessel.

12. The in-line mooring chain tensioner recited in claim 1 further comprising a chain cruciform proximate the first opening in the first end of the chassis.

13. The in-line mooring chain tensioner recited in claim 1 further comprising a chain cruciform proximate the second opening in the chassis.

14. The in-line mooring chain tensioner recited in claim 1 further comprising a sensor responsive to the tension load on the chassis.

15. The in-line mooring chain tensioner recited in claim 4 further comprising a sensor responsive to the position of the hydraulic actuator.

16. The in-line mooring chain tensioner recited in claim 5 further comprising a first sensor responsive to the position of the first chain stopper and a second sensor responsive to the position of the second chain stopper.

17. The in-line mooring chain tensioner recited in claim 3 further comprising a housing within the chassis surrounding the first chain stopper on at least two sides.

18. The in-line mooring chain tensioner recited in claim 4 wherein the base plate of the removable chain jack bears against the housing when the chain jack moves a chain passing through the in-line chain tensioner.

19. The in-line mooring chain tensioner recited in claim 4 further comprising a gate configured to close the central opening in the base plate around a chain passing through the chain tensioner.

20. The in-line mooring chain tensioner recited in claim 4 further comprising a gate configured to close the opening in the moveable plate around a chain passing through the chain tensioner.

21. A method for tensioning a subsea anchor line comprising:

providing a mooring connector in an anchor line between a first lower portion and a second upper portion comprised of chain, said mooring connecter configured to receive a removable chain jack; and, attaching a removable chain jack to the mooring connector using a remotely operated vehicle (ROV) controlled by a first umbilical from a surface vessel.

22. The method recited in claim 21 wherein attaching a removable chain jack to the mooring connector is performed while the anchor line is under tension.

23. The method recited in claim 21 further comprising:

moving the upper portion of the anchor line relative to the lower portion of the anchor line and the mooring connector by actuating the chain jack via a second umbilical from the surface vessel.

24. The method recited in claim 23 wherein power to the chain jack is provided via the second umbilical.

25. The method recited in claim 23 further comprising:

locking the upper portion of the anchor line to the mooring connector.

26. The method recited in claim 25 further comprising:

detaching the removable chain jack from the mooring connector using the remotely operated vehicle (ROV) controlled by the first umbilical; and, recovering the removable chain jack at the surface vessel.

* * * * *